US011083361B2

(12) United States Patent
Ori

(10) Patent No.: US 11,083,361 B2
(45) Date of Patent: Aug. 10, 2021

(54) SANITIZING TREADABLE MAT

(71) Applicant: APPENNINO DI ORI VITTORIO & C. S.N.C., Bologna (IT)

(72) Inventor: Vittorio Ori, Bologna (IT)

(73) Assignee: APPENNINO DI ORI VITTORIO & C. S.N.C., Bologna (IT)

( * ) Notice: Subject to any disclaimer, the term of this patent is extended or adjusted under 35 U.S.C. 154(b) by 430 days.

(21) Appl. No.: 15/558,002

(22) PCT Filed: Mar. 11, 2016

(86) PCT No.: PCT/IB2016/051396
§ 371 (c)(1),
(2) Date: Sep. 13, 2017

(87) PCT Pub. No.: WO2016/147087
PCT Pub. Date: Sep. 22, 2016

(65) Prior Publication Data

US 2018/0042449 A1 Feb. 15, 2018

(30) Foreign Application Priority Data

Mar. 13, 2015 (IT) ..... BS2015A000040

(51) Int. Cl.
*A61L 2/18* (2006.01)
*A47L 23/26* (2006.01)
*A47L 23/02* (2006.01)

(52) U.S. Cl.
CPC ..... *A47L 23/263* (2013.01); *A47L 23/02* (2013.01); *A47L 23/26* (2013.01); *A47L 23/266* (2013.01); *A47L 2601/02* (2013.01)

(58) Field of Classification Search
CPC ..... A61L 2/22; A61L 2/18
See application file for complete search history.

(56) References Cited

U.S. PATENT DOCUMENTS 1,992,648 A 2/1935 Browne
3,696,459 A 10/1972 Kucera et al.
(Continued)

FOREIGN PATENT DOCUMENTS

EP 2 095 756 A2 9/2009
FR 2 555 035 A1 5/1985
(Continued)

OTHER PUBLICATIONS

International Search Report Issued for PCT/IB2016/051396, dated Jun. 28, 2016.

*Primary Examiner* — Donald R Spamer
(74) *Attorney, Agent, or Firm* — Arent Fox LLP

(57) ABSTRACT

A treadable mat comprises at least one sanitisation portion (10; 110) treadable by a user and provided with sanitisation means suitable to dispense a sanitising substance. The sanitisation portion comprises a treadable support surface (14). The sanitisation means are housed in a sanitisation seat (16) formed in the sanitisation portion below said support surface 14. The sanitisation means comprise at least one tank (22; 120) containing the sanitising substance, at least one dispensing nozzle (24; 122) in fluidic communication with said tank (22; 120), said dispensing nozzle having an open end on said support surface, and actuator means (30; 130) operable to generate a spray or a vaporized or nebulised jet of the sanitising substance in the presence of a sanitisation command signal.

17 Claims, 4 Drawing Sheets

(56) References Cited

U.S. PATENT DOCUMENTS

| | | | | |
|---|---|---|---|---|
| 3,726,437 | A * | 4/1973 | Siegel | B65D 83/262 222/648 |
| 4,147,284 | A * | 4/1979 | Mizzi | B05B 9/0822 222/401 |
| 4,866,805 | A * | 9/1989 | Oden | A47L 23/266 15/104.92 |
| 5,297,309 | A * | 3/1994 | Rotoli | A47L 23/26 15/104.92 |
| 6,668,842 | B1 * | 12/2003 | Wilke | A47L 23/02 134/113 |
| 8,161,590 | B2 | 4/2012 | Feeg et al. | |
| 2007/0271715 | A1 * | 11/2007 | Scoralle | A47L 23/22 15/104.92 |
| 2008/0067262 | A1 * | 3/2008 | Varanasi | B05B 1/24 239/13 |
| 2009/0126139 | A1 | 5/2009 | Batti et al. | |
| 2012/0042460 | A1 * | 2/2012 | Kessler | A47L 23/263 15/97.2 |
| 2012/0167325 | A1 * | 7/2012 | Omidi | A47L 23/263 15/210.1 |
| 2012/0167338 | A1 | 7/2012 | Williams | |
| 2014/0305470 | A1 | 10/2014 | Desu-Kalyanam | |
| 2015/0074887 | A1 * | 3/2015 | Theuerl | A61L 2/22 4/222 |
| 2015/0096597 | A1 * | 4/2015 | Patel | A47L 23/266 134/18 |

FOREIGN PATENT DOCUMENTS

| | | | |
|---|---|---|---|
| JP | 2008272351 | A | 11/2008 |
| KR | 20050116196 | A | 12/2005 |
| KR | 100614876 | B1 | 8/2006 |
| WO | 01/74227 | A2 | 10/2001 |

* cited by examiner

SANITIZING TREADABLE MAT

This invention relates to a treadable mat, in particular a doormat, with sanitising function of the support surfaces of a user of the mat, for example of the shoes.

Mats with sanitising functions have already been proposed. In some embodiments, for example described in U.S. Pat. No. 1,992,648, U.S. Pat. No. 3,696,459 and FR255503, a sanitising substance in the liquid state is contained in the mat and is in contact with a spongy or porous layer on which the user's foot rests. Due to the user's weight, this spongy or porous layer is soaked with the sanitising substance, which then comes in contact with the soles. This solution suffers from some drawbacks. For example, the amount of sanitising substance dispensed is not adjustable and controllable, but depends on the user's weight. Especially if the weight is high, the mat can release an amount of substance such as to wet the soles excessively. Excessively wet soles then leave traces on the floor of the home. Furthermore, the layer of sponge, porous or fibrous material wears rather quickly.

Other embodiments, described for example in EP2095756 and U.S. Pat. No. 8,161,590, instead provide complex automated systems for cleaning and sanitising the soles comprising, for example, rotating rollers, which make the mat suitable only for particular applications of the professional or industrial type.

The purpose of this invention is to propose a treadable mat having means of sanitising the soles, which does not suffer from the drawbacks described above with reference to the doormats according to the known technique, and which is, at the same time, both effective, simple and economical to manufacture and with overall dimensions similar to a traditional doormat, so it can be widely used also in the domestic environment in place of a traditional doormat.

This purpose is achieved with a treadable mat according to claim 1. The dependent claims describe preferred embodiments of the invention.

The characteristics and advantages of the treadable mat according to the invention will, in any case, be evident from the following description of its preferred embodiments, provided by way of non-limiting example, with reference to the accompanying figures, in which.

In said drawings, 1; 100 indicates a treadable mat, for example a doormat, according to the invention, as a whole.

In a general embodiment, the mat comprises at least one sanitisation portion 10; 110 treadable by a user and provided with sanitisation means suitable to dispense a sanitising substance on the surface of the user, for example the sole of a shoe, which rests on the sanitisation portion 10;110.

In a preferred embodiment, the mat 1; 100 according to the invention has a rectangular shape and the typical dimensions of a traditional doormat.

Figure 1:
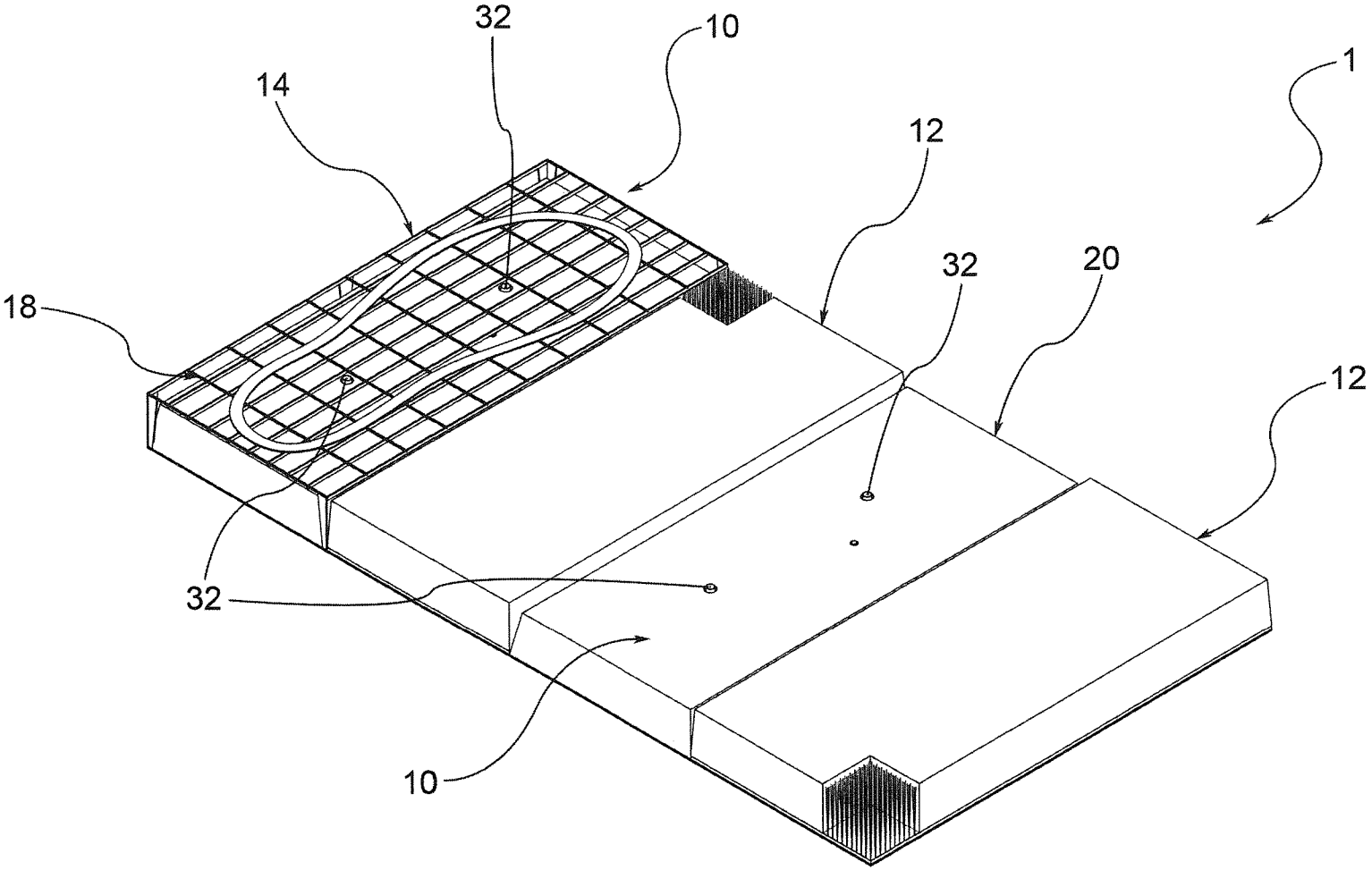
FIG. 1 is a perspective view of a mat according to the invention provided with two sanitisation portions.

Preferably, as illustrated for example in FIG. 1, the mat 1; 100 is provided with two sanitisation portions 10;110 well demarcated and whose width is equal to, or slightly greater than, that of the sole of a shoe, for a simultaneous treatment of both soles of a user who pauses on the mat. For example, each sanitisation portion 10; 110 has a rectangular shape and a surface area substantially equal to one-fourth of the total surface of the mat 1; 100. For example, the two sanitisation portions 10; 110 alternate with traditional carpet support areas 12, for example of equal width.

Each sanitisation portion 10; 110 comprises a treadable support surface 14 suitable for supporting the user's weight. The sanitisation means are housed in a sanitisation seat 16 formed in the of sanitisation portion 10; 110 below this support surface 14. Therefore, the support surface 14 is sufficiently rigid so as to resist the user's weight and protect the underlying sanitisation means.

For example, the support surface 14 comprises a metal support grid 18. Immediately below this metal grid 18, a cover 20 can be provided suitable to prevent the entry of external agents in the sanitisation seat 16.

Figure 2:
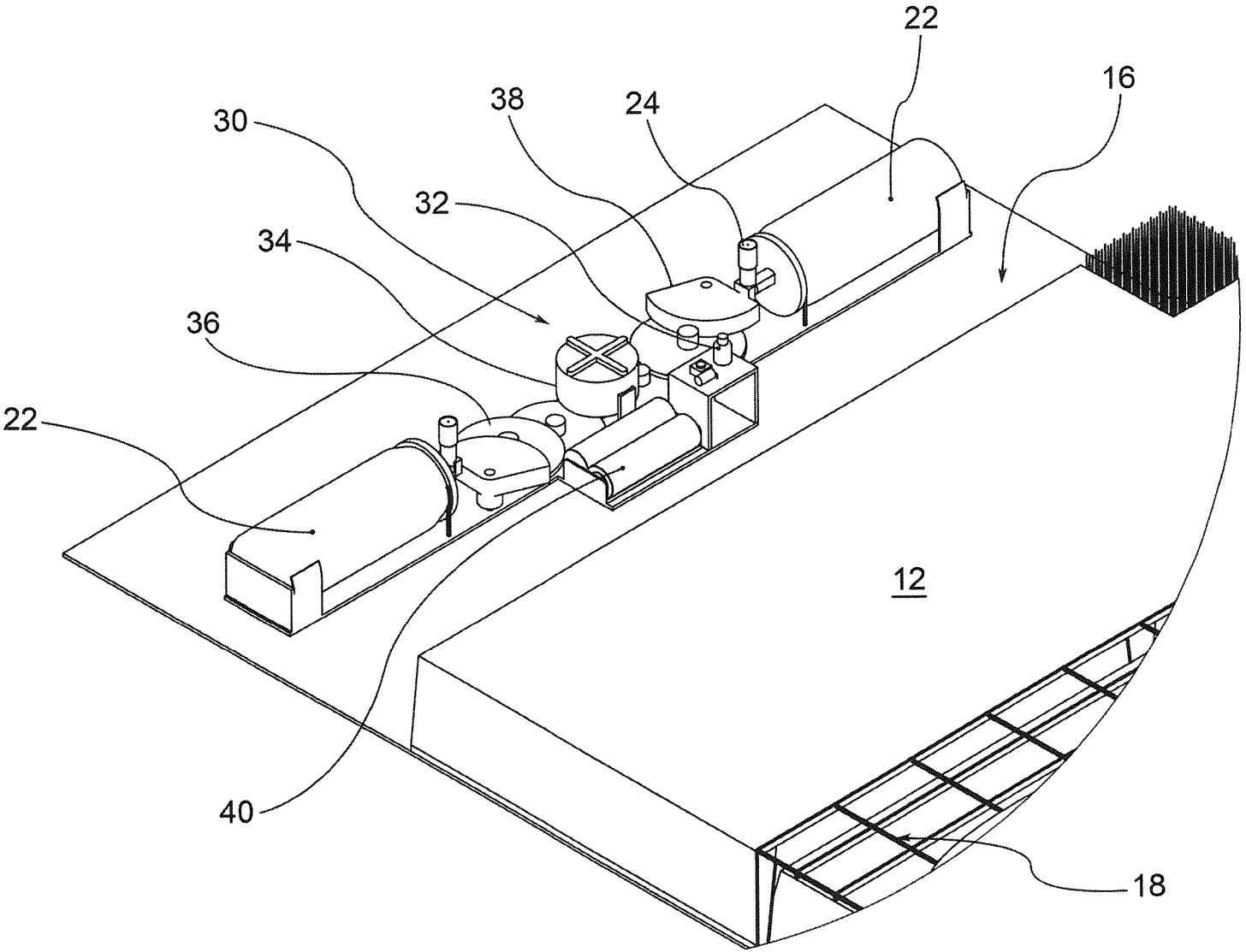
FIG. 2 illustrates the internal components of one of the sanitisation portions.

In one embodiment illustrated in FIGS. 1 and 2, the sanitisation means comprise at least one tank 22 containing the sanitising substance mixed with a gaseous propellant under pressure. To the tank 22 is fluidically connected to at least one dispensing nozzle 24 having an open end on, or towards, the support surface 14 of the sanitisation portion 10. Each dispensing nozzle 24 is connected to the tank 22 through valve means—not shown—actuatable to put the tank 22 in fluidic communication with the dispensing nozzle 24. When the valve means are actuated, the interior of the tank 22 is put in communication with the outside environment, and then a flow of the sanitising substance is automatically sprayed from the dispensing nozzle 24 thanks to gaseous propellant under pressure.

In a preferred embodiment, the tank-nozzle-valve means assembly is realized with an aerosol spray can of the conventional type. In order to reduce the overall height of the mat 1, the tank, for example in the form of an aerosol can, it is arranged horizontally, with only the dispensing nozzle 24 oriented vertically upwards.

In one embodiment, to have a quantity of sanitising substance that allows a long duration of the sanitising treatment, and at the same time reduces the overall height of the mat height, two tanks 22 are used aligned axially in the direction of greater extension of the sanitisation portion, each with its respective dispensing nozzle 24. For example, the two tanks 22 are positioned at the ends of the sanitisation portion 10, with the dispensing nozzles 24 facing each other and at a distance such as to spray the sanitising substance as uniformly as possible on the sole.

In these conditions, the thickness of the mat 1 can be contained within about 25 mm.

The valve means are actuatable by electromechanical actuator means generally indicated with 30. These electromechanical actuator means 30 are operable to interact with said valve means in order to actuate the valve means in the presence of a sanitisation command signal.

In one embodiment, the sanitisation command signal is supplied to the electromechanical actuator means by a user presence sensor 32.

Preferably, the user presence sensor 32 is facing or touches the support surface and is suitable to detect the presence of at least one foot of the user on said support surface.

In one embodiment, the electromechanical means 30 comprise a motor apparatus 34, for example a DC electric motor, actuatable by the sanitisation command signal and return means 36 commandable by the motor apparatus to act on the valve means.

For example, in one embodiment wherein the valve means comprise a shutter element that can move between an inactive advanced position, in which it prevents the transit of the sanitising substance from the tank to the nozzle, and a retracted position, in which it permits such transit, the return means 36 comprise a cam organ 38 suitable to push said shutter element from the advanced position to the retracted position.

Figure 3:
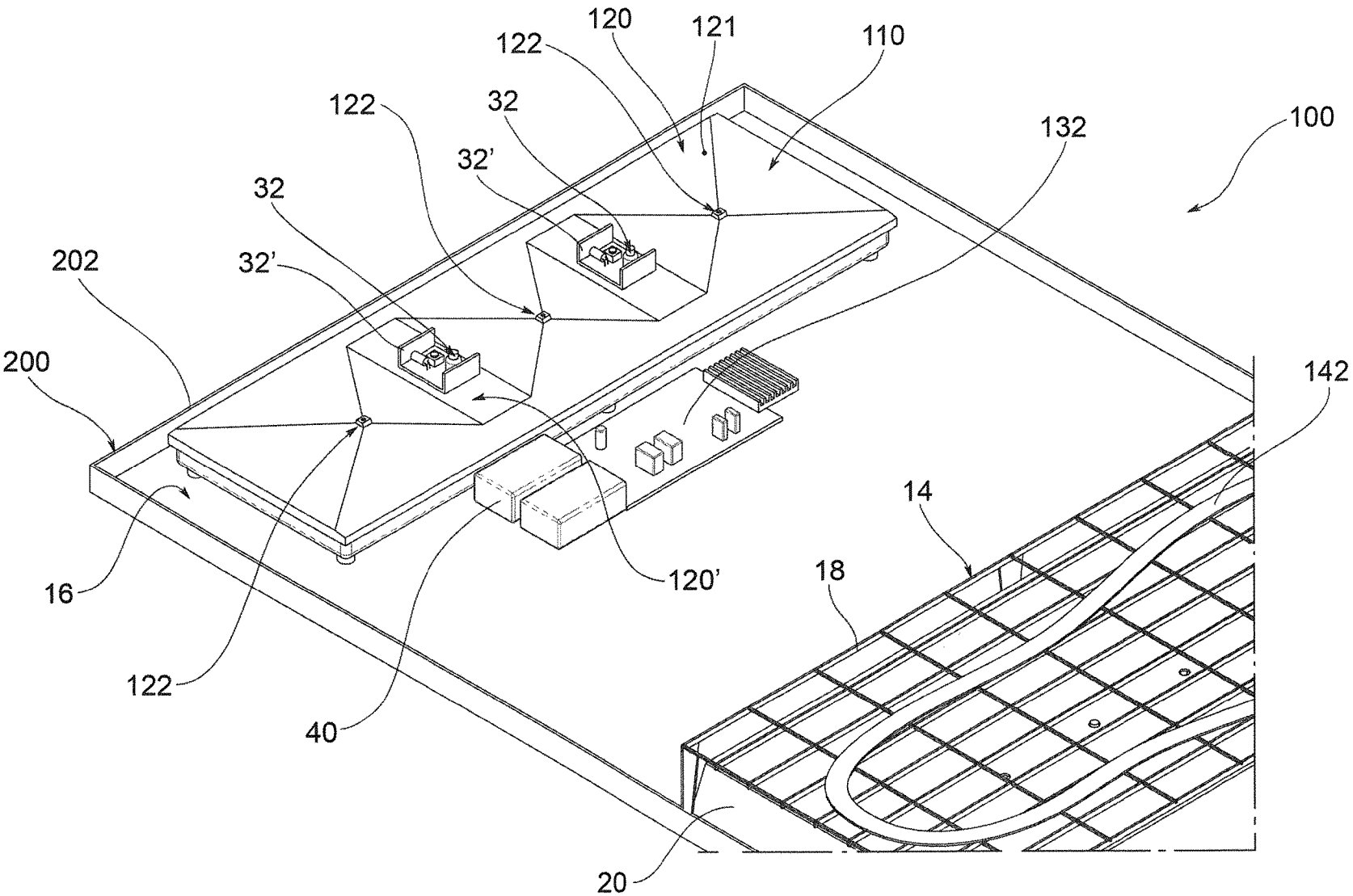
FIG. 3 shows the internal components of one of the sanitisation portions, in one embodiment variant.
Figure 4:
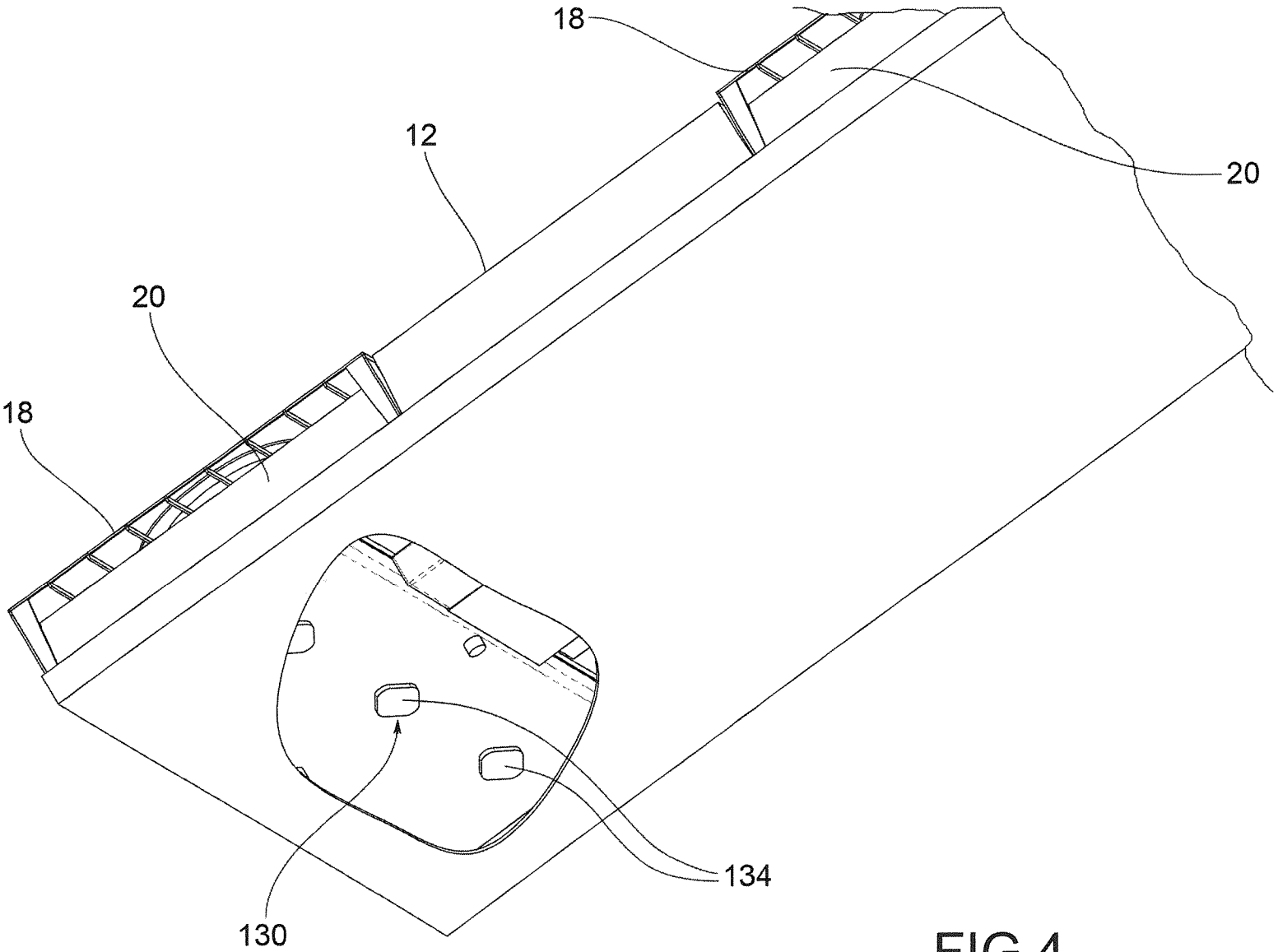
FIG. 4 is a cross-section of the mat seen from below to show part of the lower side of one of the sanitisation portions of FIG. 3.

FIGS. 3 and 4 illustrate a mat 100 having sanitisation portions 110 according to one embodiment variant that provides for the dispensing of a sanitising substance in the form of a vaporized or nebulised jet.

Each sanitisation portion 110 comprises a tank 120 suitable to contain a sanitising liquid to be vaporized or nebulised. For example, the sanitising liquid is an aqueous solution in which a powder sanitising substance is dissolved.

The tank 120 is provided with one or more dispensing nozzles 122 suitable to allow the discharge of the sanitising substance in the form of a vaporized or nebulised jet.

In one embodiment, the tank 120 has a flattened and extended form in plan view so as to substantially cover almost all the surface of the sanitisation portion 110. Preferably, there are three dispensing nozzles 122 equally spaced from each other so as to cover all the sizes of shoe that rest on the sanitisation portions 110.

Each sanitisation portion 110 also comprises vaporization or nebulisation means 130 commandable to vaporize or nebulise the sanitising liquid.

In one embodiment, such vaporization or nebulisation means comprise one or more heating cells 134 applied on the bottom of the tank 120.

In other embodiments, ultrasonic actuators or suitable means can be used to produce a nebulisation of the sanitising liquid.

Therefore, the sanitising substance dispensed by the dispensing nozzles 122 may be formed by particles in the vapor and/or liquid state, in the form of very small drops.

The vaporization or nebulisation means 130 are controlled by an electronic control card 132, for example, positioned to the side of the tank 120.

In one embodiment, the vaporization or nebulisation means 130 are actuated following the detection of the presence of a shoe on the support surface of the sanitisation portion 110 by means of at least one user presence sensor 32, for example a photocell.

Preferably two presence sensors 32 are provided so as to detect the presence of different sizes of shoes.

In one embodiment, each user presence sensor 32 is mounted on a respective electronic card 32' positioned on the tank 120.

In one embodiment, the upper side of the tank 120 has one or more recessed portions 120' in which are positioned the electronic cards 32' of the presence sensors 32.

In one embodiment, the tank 120 is provided with a removable cover 121 and/or a topping-off opening to allow the filling of the tank with the sanitising liquid.

To this end, liquid level sensors are provided suitable to signal the lowering of the sanitising liquid beyond a predetermined threshold.

In one embodiment, the electrical and electronic devices of the mat 1; 100 are powered by a battery pack 40 housed in the sanitisation seat 16. In this way, the mat has no electrical connection cables to an electric current socket and can be positioned independently of the presence of an electric socket near the mat.

In one embodiment, the mat 1; 100 comprises a base 200 in the form of a tray or pan, i.e., provided with raised edges 202, in which are formed the seats 16 for the sanitisation portions 10; 110 and suitable to receive the carpet portions 12.

In a preferred embodiment, the sanitisation portions 10 and the carpet portions 12 are removable from the base 200 so as to allow adequate periodic cleaning of such base 100.

For example, the base 200 can be made of a plastic or elastomeric material, for example of a semi-rigid silicone rubber, so as to be non-slip and easily cleanable and washable.

In one embodiment, the carpet portions 12 are connected to the base 200 by means of Velcro® or clip-on devices.

Note that, especially in the case of dispensing a vaporized or nebulised jet, the support grid 18 can be made with very narrow mesh so as to prevent particularly thin heels from getting wedged in it.

In one embodiment, the support surface 14 can be associated with luminous signaling devices 142 suitable to indicate the sanitisation area, even in the dark. For example, such signaling devices can comprise an LED strip.

In one embodiment, the electronic control card 132 may be provided with a communication interface for connection to a remote control device, for example a smartphone or a home automation system, so as to allow to remotely controlling the state of operation of the mat.

It is clear that the mat described above allows achieving the predefined purposes.

Thanks to the configuration and arrangement of the sanitisation means, the mat is still very compact and does not exceed the measurements of a mat, for example, a doormat without sanitisation means.

For example, in the case of use of the tank 120 for the sanitising liquid, the thickness of the mat can even be equal to, or less than, 20 mm.

Therefore, the mat according to the invention can replace a conventional doormat.

In any case, the mat has a height such as not to obstruct the passage of a wheelchair.

The mat is light enough to be handled like a conventional doormat.

The sanitisation treatment is fully automatic and requires no action by the user.

In a preferred embodiment, the treatment starts automatically when the user puts his feet on the support surface of the sanitisation surface and ends automatically, for example by pre-setting the duration of the dispensing of the sanitising substance or when the user moves from the support surface.

The structure of the sanitisation means and their actuation devices, in any case, particularly simple and thus reliable, and the mat can be manufactured with components existing on the market. This also allows reducing the production costs of the mat, to the advantage of its widespread use, even and especially in the home.

The sanitisation of the soles performed with a spray of a sanitising substance contained in one or more pressurized tanks or by means of a nebulised or vaporized jet allows dosing the amount of the substance dispensed and not excessively wetting the soles.

Thanks to the tray-shaped structure with removable components, it is easy to restore the initial hygienic situation by periodically removing the dirt accumulated in the tray with normal floor-cleaning equipment, for example with a vacuum cleaner.

The removable components can be made so as to be washable.

The support grid 18 is made for the support of any shoes, from those with stiletto heels to cleated soles, ensuring a high degree of safety.

The modularity of the mat structure allows varying the composition according to the environment of placement and the type of dirt to be removed.

Wear or damage to the carpet portions are solved with their replacement, without the need to use adhesives.

The mat does not need to be built in to the floor avoiding costly interventions.

In the embodiment with the means of vaporization or nebulisation, there are no mechanical moving parts, to the advantage of the reliability and silence of the mat.

To the embodiments of the mat according to the invention, a technician in the field, to satisfy contingent requirements, may make modifications, adaptations and replacements of members with others functionally equivalent, without departing from the scope of the following claims. Each of the characteristics described as belonging to a possible embodiment can be achieved independently from the other embodiments described.

The invention claimed is:

1. A doormat, comprising at least one sanitisation portion treadable by a user and provided with sanitisation means suitable to dispense a sanitising substance towards the surface of the user that rests on said at least one sanitisation portion, wherein said at least one sanitisation portion comprises a treadable support surface, and wherein said sanitisation means is housed in a sanitisation seat formed in the at least one sanitisation portion below said treadable support surface, said sanitisation means comprising:

at least one tank containing the sanitising substance;

at least one dispensing nozzle in fluidic communication with said at least one tank, said dispensing nozzle having an open end on said treadable support surface; and an actuator means operable to generate a spray or a vaporised or nebulised jet of the sanitising substance in the presence of a sanitisation command signal supplied to the actuator means by a user presence sensor, and the doormat further comprising at least one carpet portion separated from the at least one sanitisation portion, said at least one carpet portion being suitable to remove dirt from both support surfaces of feet of the user and having a width suitable to receive feet of the user, wherein the at least one sanitisation portion and the at least one carpet portion are substantially coplanar and the doormat has a maximum height from the ground of less than 30 mm.

2. The doormat according to claim 1, wherein the at least one tank contains the sanitising substance mixed with a gaseous propellant under pressure, wherein the at least one dispensing nozzle is connected to the at least one tank through valve means actuatable to put the at least one tank in fluidic communication with said dispensing nozzle, and wherein the actuator means is an electromechanical actuator means operable to interact with said valve means so as to actuate the valve means in the presence of the sanitisation command signal.

3. The doormat according to claim 2, wherein said electromechanical means comprises a motor apparatus actuatable by the sanitisation command signal and return means commandable by the motor apparatus to act on the valve means.

4. The doormat according to claim 2, wherein the valve means comprises a shutter element that can move between an inactive advanced position, in which it prevents the transit of the sanitising substance from the at least one tank to the nozzle, and a retracted position, in which it permits such transit, said return means comprising a cam organ suitable to push said shutter element from the advanced position to the retracted position.

5. The doormat according to claim 1, wherein the at least one tank is configured to contain the sanitising substance in liquid form, and wherein the actuator means comprises means of vaporisation or nebulisation operable to vaporise or nebulise the sanitising liquid.

6. The doormat according to claim 5, wherein the vaporisation or nebulisation means comprises one or more heating cells.

7. The doormat according to claim 5, wherein the vaporisation or nebulisation means is commanded by an electronic control card.

8. The doormat according to claim 5, wherein the at least one tank is provided with a removable cover and/or a topping-off opening to allow the filling of the at least one tank with the sanitising liquid.

9. The doormat according to claim 1, wherein said user presence sensor is facing or touches the treadable support surface and is suitable to detect the presence of at least one foot of the user on said treadable support surface.

10. The doormat according to claim 1, further comprising a battery pack housed in the sanitisation seat that powers electric or electronic devices of the at least one sanitisation portion.

11. The doormat according to claim 1, wherein said treadable support surface comprises a support grid suitable to bear the weight of a person.

12. The doormat according to claim 1, further comprising two sanitisation portions configured to perform simultaneous sanitisation of both support surfaces of feet of the user.

13. The doormat according to claim 12, wherein said two sanitisation portions are separated from each other and are placed alongside of respective carpet portions, and suitable to clean the support surfaces of feet of the user.

14. The doormat according to claim 1, further comprising a base in the form of a tray or pan in which are formed the sanitisation seat for the at least one sanitisation portion and suitable to receive the at least one carpet portion, the at least one sanitisation portion and the at least one carpet portion being connected in a removable manner to said base.

15. The doormat according to claim 1, wherein one or more luminous signaling devices suitable to indicate a sanitisation area are associated with or in proximity to the treadable support surface.

16. The doormat according to claim 1, further comprising a communication interface adapted to connect to a remote control device, which allows a user to remotely control the state of operation of the doormat.

17. The doormat according to claim 16, wherein the remote control device comprises a smartphone or a home automation system.

* * * * *